US005309582A

United States Patent [19]

Henkin et al.

[11] Patent Number: 5,309,582

[45] Date of Patent: * May 10, 1994

[54] TAP WATER POWERED WATER RECIRCULATION SYSTEM

[76] Inventors: Melvyn L. Henkin, 5011 Donna Ave., Tarzana, Calif. 91356; Jordan M. Laby, 3038 Bayshore, Ventura, Calif. 93001

[ * ] Notice: The portion of the term of this patent subsequent to Nov. 30, 2010 has been disclaimed.

[21] Appl. No.: 755,021

[22] Filed: Sep. 4, 1991

[51] Int. Cl.[5] ..... A47K 3/22

[52] U.S. Cl. ..... 4/603; 4/596; 4/597

[58] Field of Search ..... 4/546, 559, 597, 602, 4/603, 604, 605, 665, 596; 210/416.2; 239/124, 310, 318

[56] References Cited

U.S. PATENT DOCUMENTS

| | | | |
|---|---|---|---|
| 1,065,265 | 6/1913 | Nordmark | 4/601 |
| 2,308,452 | 1/1943 | Ortyl | 4/603 |
| 3,106,345 | 10/1963 | Wukowitz | 239/318 |
| 3,606,618 | 9/1971 | Veech | 4/603 |
| 3,646,618 | 3/1972 | Johnson | 4/597 X |
| 3,764,074 | 10/1973 | James | 239/318 |
| 4,224,700 | 9/1980 | Bloys | 4/603 |
| 4,413,363 | 11/1983 | Troiano | 4/599 |
| 4,828,709 | 5/1989 | Houser et al. | 4/616 X |
| 4,893,364 | 1/1990 | Keeler | 4/597 |
| 4,975,992 | 12/1990 | Patterson et al. | 4/599 |
| 4,989,279 | 2/1991 | Powell | 4/612 |

FOREIGN PATENT DOCUMENTS

| | | | |
|---|---|---|---|
| 0070256 | 7/1892 | Fed. Rep. of Germany | 4/603 |

*Primary Examiner*—William A. Cuchlinski, Jr.
*Assistant Examiner*—W. Morris Worth
*Attorney, Agent, or Firm*—Freilich Hornbaker Rosen

[57] ABSTRACT

A water recirculation system which derives energy from an available pressurized tap water supply to filter and return previously discharged water to a water discharge device. A system embodiment includes a shower head and a tap water powered pump for returning water discharged from the shower head to the pump for mixing with the supplied tap water for delivery to the shower head inlet.

55 Claims, 8 Drawing Sheets

TAP WATER POWERED WATER RECIRCULATION SYSTEM

FIELD OF THE INVENTION

This invention relates generally to tap water powered water recirculation systems and more particularly to shower water delivery systems modified to recirculate discharged shower water.

BACKGROUND OF THE INVENTION

Water shortages frequently occur in many parts of the United States and the rest of the world. As a consequence, considerable effort has been expended to develop low water utilization devices such as low flow shower heads, toilets, etc. Many municipalities in California, for example, encourage or mandate the use of toilets which use less than 2.0 gallons per flush and shower heads which discharge less than 3.0 gallons per minute. Various such devices are widely commercially available and are described in the literature. In general, although such devices perform adequately, they usually do not function as well as conventional full flow devices. For example, whereas conventional full flow shower heads typically discharge 3.0 to 8.0 gallons per minute, low flow shower heads which discharge less than 3.0 gallons per minute, are often perceived as being weak and only marginally satisfactory.

The present invention is directed to plumbing systems utilizing a pressurized tap water supply for enhancing water delivery, without consuming additional supply water, by recirculating a portion of the previously discharged water.

The concept of recirculating discharged shower water has been known for many years primarily for use, for example, in boats, trailers, motor homes, and the like; e.g.,

| U.S. Pat. No. | Inventor |
|---|---|
| 1,065,265 | Nordmark |
| 2,308,452 | Ortyl |
| 3,606,618 | Veech |
| 3,646,618 | Johnson |
| 4,224,700 | Bloys |
| 4,413,363 | Troviano |
| 4,828,709 | Houser |
| 4,893,364 | Keeler |

These systems typically use electric motor driven pumps for recirculating discharged shower water to a shower head. A portable shower stall system utilizing a water driven pump to transport water from a base to a sink/drain is discussed in U.S. Pat. No. 4,975,992.

SUMMARY OF THE INVENTION

The present invention is directed to a water recirculation system which derives energy from an available pressurized tap water supply to filter and return previously discharged water to a water discharge device, such as a shower head. As an example, embodiments of the invention are able to discharge water from a shower head at a flow rate which exceeds twice the flow rate of the tap water supplied to the shower head, which might be on the order of 1.5–2.0 gallons per minute. Thus, although a shower delivery system consumes tap water at a low flow rate consistent with water conservation objectives, it nevertheless delivers a full flow rate to a user.

Water recirculation systems in accordance with the invention are characterized by a water discharge device, e.g., a shower head, and a tap water powered pump for returning water discharged from the discharge device for mixing with supplied tap water for delivery to the discharge device.

Preferred embodiments of the invention particularly suited for after-market shower water delivery systems, both for stall shower and bathtub configurations, are described hereinafter. A concurrently filed U.S. patent application, Ser. No. 07/754,606 entitled "Tap Water Powered Shower Water Recirculation System", whose disclosure is by reference incorporated herein, describes embodiments particularly suited for new installations, both for stall shower and bathtub configurations.

In accordance with preferred embodiments of the invention, the tap water powered pump comprises a jet pump incorporated between a tap water supply pipe and a shower head. The pump includes a tap water supply inlet, a return water suction inlet, and a water discharge outlet.

In accordance with a preferred embodiment, a pooling means is provided which cooperates With an existing drain of a stall shower or bathtub to dam or block the drain to thus pool a portion of the water discharged from the shower head. A preferred pooling means is configured as a drain adapter and incorporates a drain overflow path to limit the height of the pool.

In accordance with an important feature, the preferred drain adapter includes filter means, e.g., open cell foam, for filtering water returned from the pool to the pump's return water suction inlet.

In accordance with another feature of one preferred drain adapter, a leakage path is defined for automatically depleting the pool after a user terminates his shower.

In accordance with an alternative after-market drain adapter, the drain adapter wall section for blocking the drain can be selectively positioned in either a closed position or an open position.

In accordance with a further alternative, an after-market drain adapter particularly suited for use in stall showers, is configured as a flat mat upon which a user can comfortably stand.

A tap water powered pump in accordance with the invention preferably comprises a jet pump including a driving nozzle responsive to tap water supplied to its supply inlet for discharging a high velocity stream through a suction chamber. The pump's suction inlet opens into the suction chamber thus enabling pool water to be drawn into the suction chamber and mixed with the stream for discharge through the pump's discharge outlet.

In accordance with a preferred embodiment, the jet pump is housed within a pipe section mounted in essentially the same manner as a standard shower arm.

In accordance with an important feature of the preferred jet pump, a unidirectional valve is provided between the pump's supply inlet and its return water suction inlet to prevent backflow into the tap water supply plumbing.

DETAILED DESCRIPTION

Figures 1A, 1B:
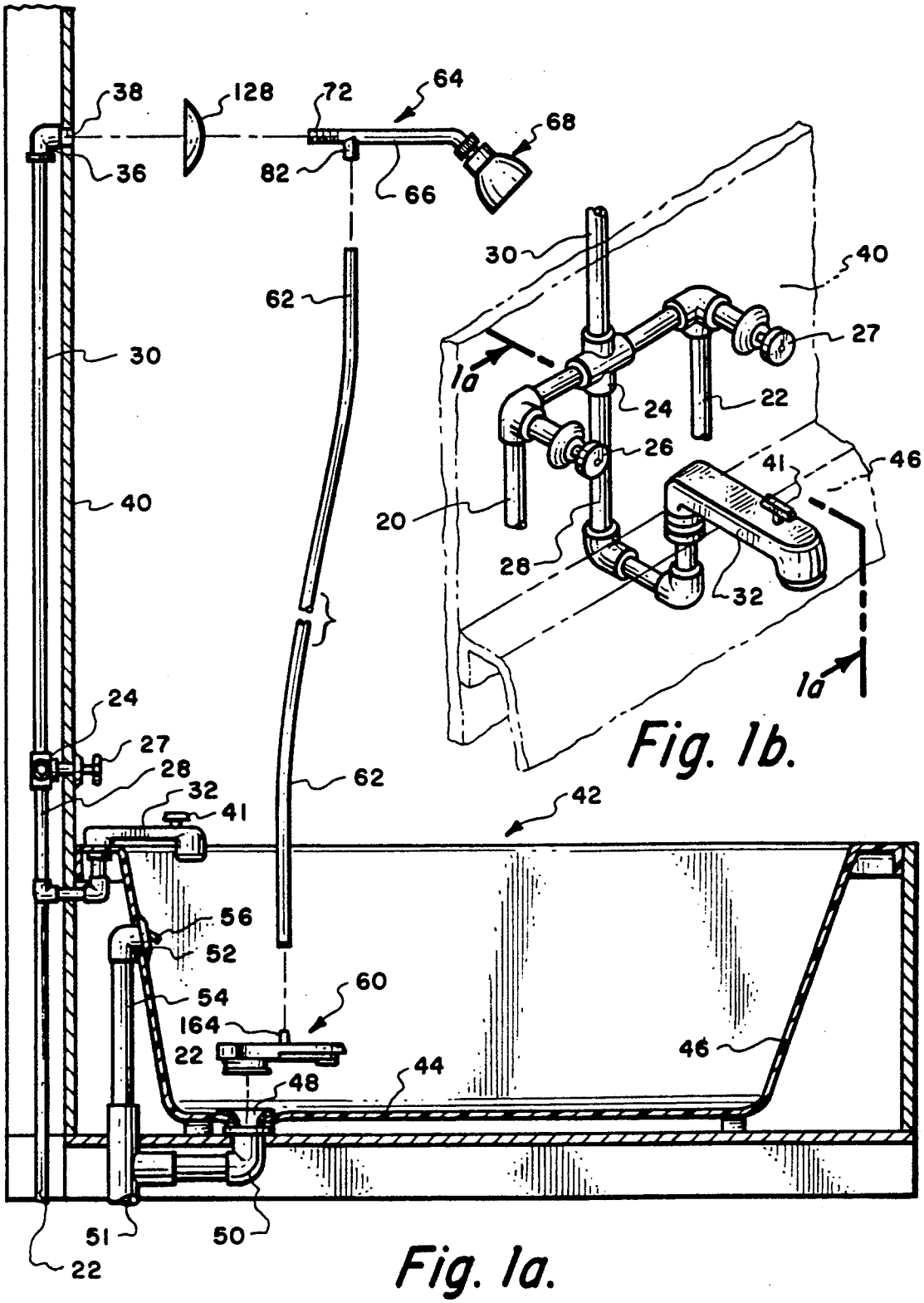
FIG. 1*a* is a sectional view of an after-market recirculation shower system in accordance with the invention utilized in an existing bathtub installation.
FIG. 1*b* is an isometric view showing a conventional shower head/bathtub faucet plumbing configuration utilized in the embodiment of FIG. 1*a;*

Attention is initially directed to FIGS. 1*a* and 1*b* which illustrate a preferred embodiment of a tap water powered water recirculation system in accordance with the invention used in conjunction with an otherwise conventional shower/bathtub installation. Such installations typically include hot and cold tap water supply pipes 20, 22 coupled to a fitting 24. Valve handles 26, 27 respectively control valves (not shown) which enable a user to establish the respective flow rates from pipes 20, 22 to fitting 24, and thus the temperature of the water delivered to pipes 28 and 30, respectively coupled to bathtub spout 32 and elbow 36 adapted to threadedly receive the end of a conventional shower arm through opening 38 in wall 40. A diverter valve 41 in spout 32 determines whether the tap water is supplied to the spout 32 or elbow 36.

The bathtub spout 32 is mounted to discharge into a bathtub 42 essentially defined by a floor 44 and a peripheral wall 46. The floor 44 defines a drain opening 48 communicating with a drain path including pipe 50 coupled to waste pipe 51. The vertically oriented peripheral wall 46 is generally provided with an overflow opening 52 which communicates with overflow pipe 54 which opens to the waste pipe 51. A valve handle 56 is typically mounted proximate to the overflow opening 52 for controlling flow from the drain pipe 50 to the waste pipe 51, i.e., the handle can either be in an open position to drain water from the bathtub 42 or a closed position to fill the bathtub from water discharged from the spout 32.

As previously noted, the elbow 36 in a typical shower/bathtub installation, receives a threaded first open end of a shower arm pipe, terminating at a shower head for discharging a shower spray upon a user standing on the tub floor 44. In order to conserve water, state of the art low flow shower heads discharge less than 3.0 gallons per minute, which many users feel is insufficient to provide a satisfying shower experience. The present invention is directed to a tap water powered water recirculation system which enables a water discharge device, e.g., a shower head, to discharge a flow rate greater than the tap water supply flow rate delivered by supply pipe 30 to elbow 36. FIGS. 1–5 show a water recirculation system embodiment in accordance with the invention incorporated in an existing shower/bathtub installation. The water recirculation system as depicted in FIG. 1*a* is essentially comprised of a water pooling means in the form of drain adapter assembly 60, a return tube 62, and a pump assembly 64, preferably contained within a pipe section 66 coupling supply elbow 36 to shower head 68.

Figure 2A:
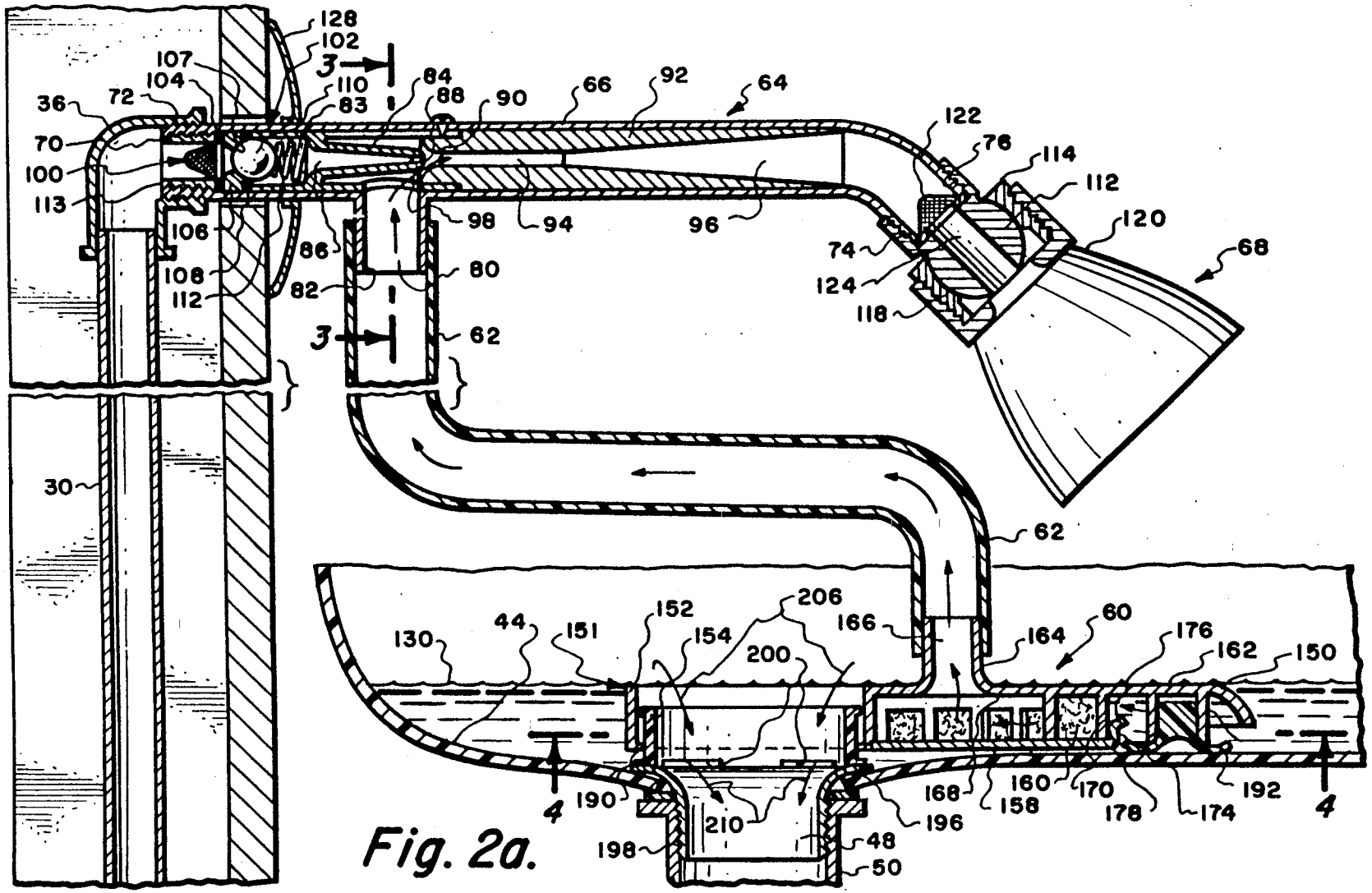
FIG. 2*a* is an enlarged sectional view depicting a preferred jet pump assembly and drain adapter assembly useful in the installation of FIG. 1*a;*
Figures 2B, 3:
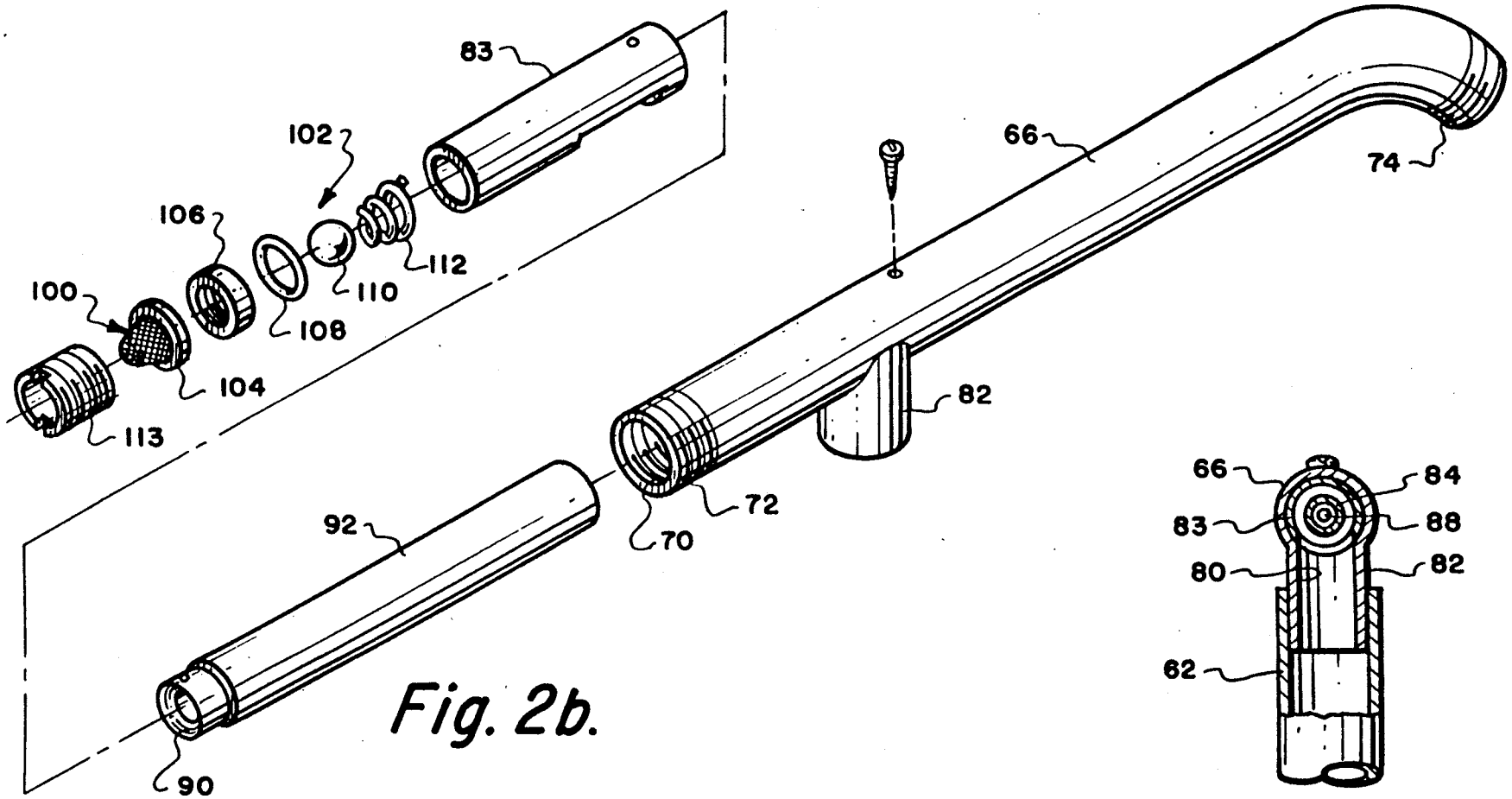
FIG. 2*b* is an isometric exploded view showing the components of the jet pump assembly of FIG. 2*a;*
FIG. 3 is a sectional view through the jet pump driving nozzle taken substantially along the plane 3—3 of FIG. 2*a;*

Attention is now directed to FIGS. 2*a* and 2*b* which illustrate the details of a preferred pump assembly 64 and drain adapter assembly 60 in accordance with the invention. The pump assembly includes a pipe arm 66 having a first open end 70 externally threaded at 72 into the supply elbow 36. A second externally threaded open end 74 is intended to receive an internally threaded collar 76 of the shower head 68. Additionally, the pipe arm 66 defines an intermediate opening 80 within a nipple 82.

A tubular member 83 is internally formed to define a converging driving nozzle 84 having an entrance 86 and an exit 88 is mounted in the pipe arm 66 proximate to the open first end 70. The nozzle exit 88 is positioned proximate to the converging mouth 90 of an elongated mixing tube 92 having an intermediate straight section 94 and a downstream diverging section 96. In response to pressurized tap water supplied from nipple 36 to the nozzle entrance 86, a high velocity water stream will be discharged from the exit 88 to produce a suction in the region or chamber 98 proximate to the exit 88 and mouth 90. The aforementioned pipe intermediate opening 80 opens into the suction chamber 98. The driving nozzle 84 is preferably dimensioned to deliver a flow rate limited to approximately 1.5–2.0 gallons per minute for typical tap water pressures, i.e., above 40 pounds per square inch. Thus, the valve handles 26, 27 (FIG. 1*b*) are primarily used in accordance with the invention for the purpose of regulating the temperature of the water discharged from shower head 68, rather than for regulating its flow rate.

An in-line screen 100 and unidirectional check valve 102 are preferably mounted in the tubular member 83 between the elbow 36 and the entrance 86 to nozzle 84. The screen 100 is preferably comprised of screen material, e.g., shaped in the form of a truncated cone, mounted across a washer or O-ring 104. The O-ring 104 mounts against a block 106. The downstream side of the block 106 forms a valve seat 107, surrounded by O-ring 108, for receiving a ball valve element 110 urged into a seated position by coil spring 112. The screen 100 and check valve elements 102 are held under compression by a plug 113 threaded into end 70 of pipe 66.

In response to pressurized tap water supplied to the open end 70 of pipe 66, the water flows past screen 100 and check valve 102 into the entrance 86 of nozzle 84. Exiting from the nozzle 84 at a high velocity, the water stream creates a suction in chamber 98 enabling it to draw water from return tube 62 into chamber 98 and the mouth 90 of mixing tube 92. The high velocity tap water stream exiting from nozzle 84 entrains the water drawn from return tube 62 resulting in a mixed water stream being delivered at the open end 74 of pipe 66.

The depicted shower head 68 can be a conventional full flow shower head capable of delivering at least twice the flow rate delivered by driving nozzle 84. The shower head 68 is comprised of the internally threaded collar 76 shown mounted on the external threads of the pipe end 74. A ball element 112, mounted on collar 76, is received in socket block 114 enabling it to swivel on the fixed ball element. The socket block 114 is depicted as being coupled by threads to a collar 118 which may be formed integral with the shower head body 120. A screen washer 122 is preferably mounted within the collar 76 in line with a water inlet passageway 124 defining the water path from the pipe end 74 to outlet openings (not shown) in the shower head body 120.

A decorative trim plate 128 is preferably mounted on the pipe 66 for engagement with the outer surface of wall 40.

Figure 4:
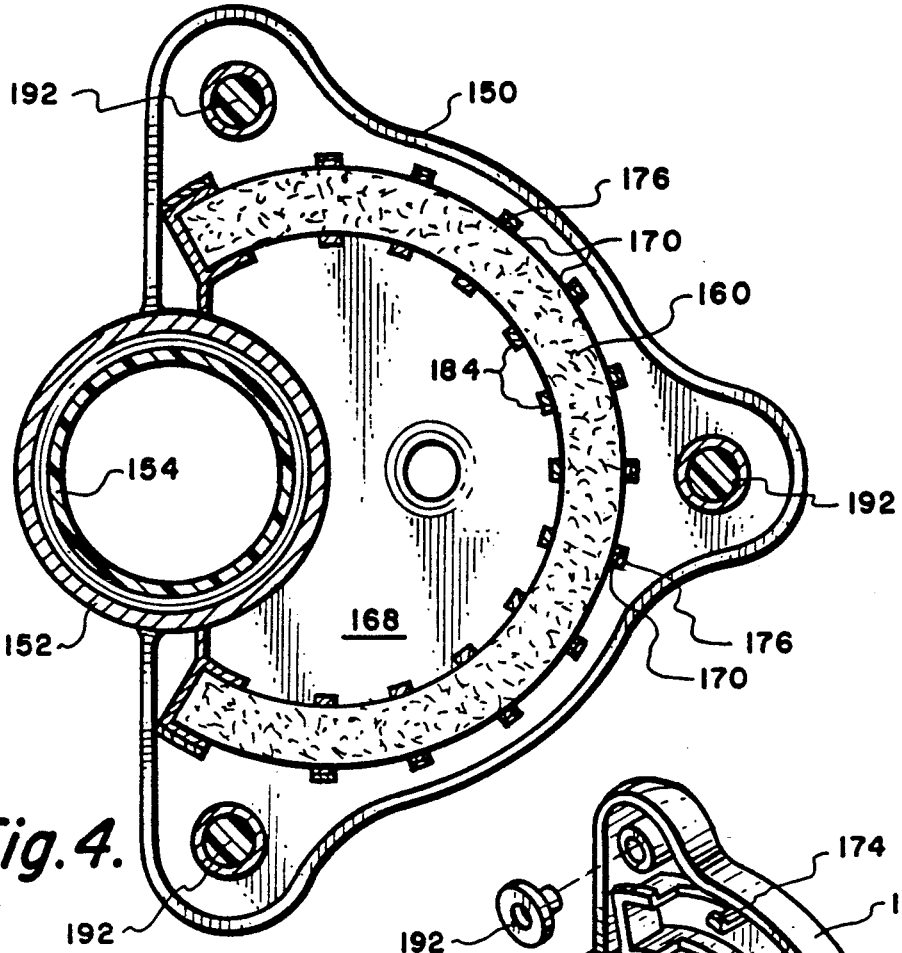
FIG. 4 is a sectional view through the drain adapter assembly taken substantially along the plane 4—4 of FIG. 2*a;*
Figure 5:
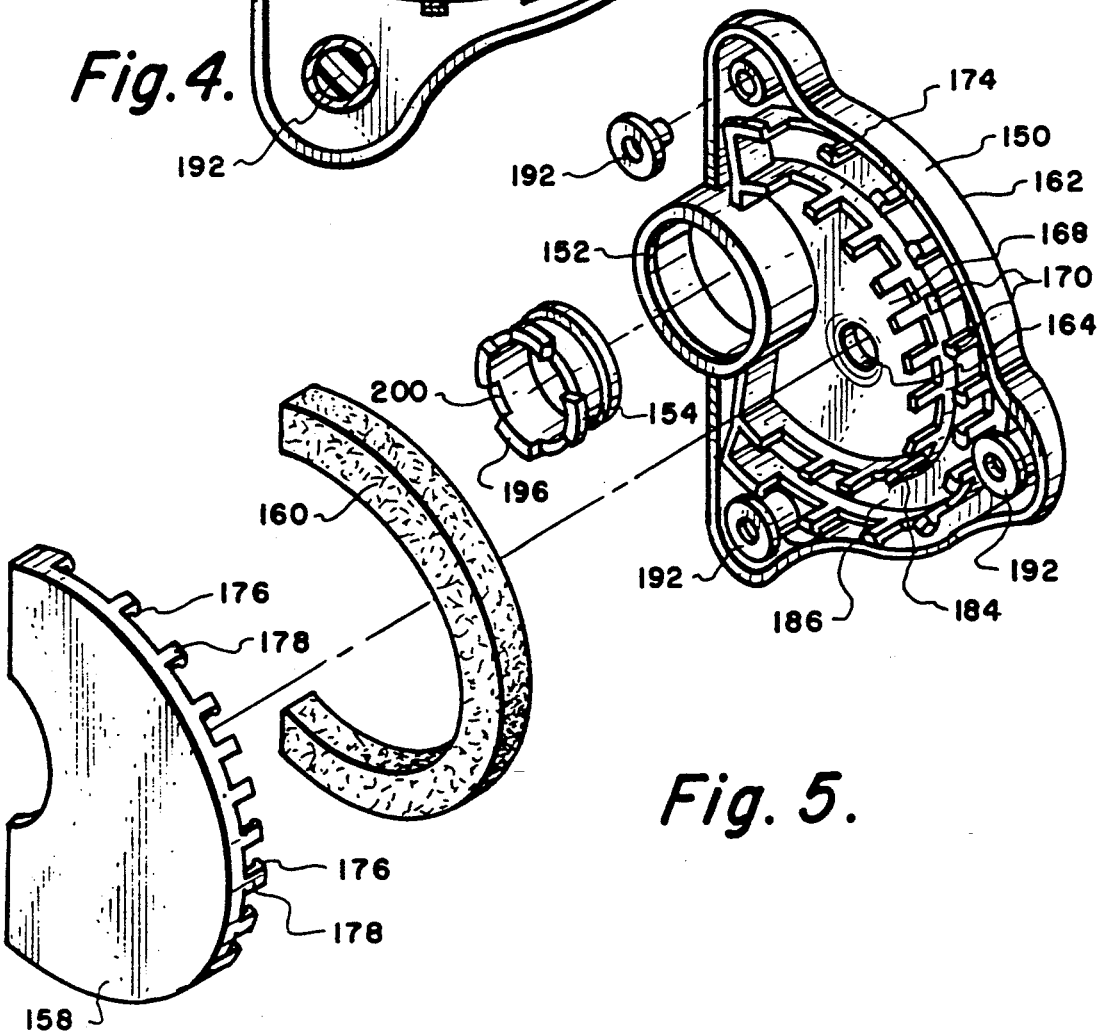
FIG. 5 is an exploded isometric view of the drain adapter assembly of FIG. 4.

The drain adapter assembly 60 depicted in FIG. 2 and shown in greater detail in FIGS. 4 and 5 functions in conjunction with the floor mounted drain opening 48 to form a pool 130 of water discharged from the shower head 68 to enable water to be returned by pump 64, via return tube 62, for mixing in the aforementioned mixing tube 92. The preferred drain adapter 60 primarily includes a housing 150 defining a dam wall 151 comprised of a fixed section 152 and a movable section 154, a bottom cover plate 158, and a piece of filter material 160.

More particularly, the housing 150 is depicted as being essentially triangularly shaped having a top plate 162 defining a suction outlet nipple 164 defining a suction outlet or return opening 166. The opening 166 through the nipple 164 opens into a pooling chamber 168 defined between the top plate 162 and the bottom cover plate 158. An outer series of arcuately arranged fingers 170 is formed in the housing 150 depending from the top plate 162. The fingers 170 are made to be somewhat resilient and have outwardly extending end projections 174 which are intended to interlock with inwardly extending end projections 176 on accurately extending fingers 178 which project upwardly from bottom cover plate 158. The fingers 170 and 178 are correspondingly arranged to enable their respective projections 174, 176 to interlock for the purpose of holding the bottom cover plate 158 to the housing 150, while still enabling it to be readily separated by a user without tools for access to the filter material 160.

The housing 150 preferably also includes an inner series of arcuately arranged fingers 184 spaced inwardly from the fingers 170 to define an arcuate channel 186 therebetween for accommodating the aforementioned filter material 160. The filter material 160 is provided to filter the water returned from the pool 130 to the pump 64 via return tube 62. The filter material 160 is preferably capable of removing hair and other particles, soap film, etc. from the water to be recirculated. It has been found that a small pore open cell foam material functions satisfactorily for this purpose.

As previously noted, the housing 150 defines a fixed dam wall section 152 comprising a substantially cylindrical wall having a small inwardly turned lower lip 190. In use, the drain adapter 60 is intended to be placed on the bathtub floor 44, held in place by suction cups 192 or other suitable fastening means, with the fixed dam wall section 152 aligned with the drain opening 48. The movable dam wall section 154, received within the fixed dam wall section 152, has an outer diameter dimension which fits closely within the inner diameter of the lip 190, but with sufficient clearance to enable it to move axially relative to the fixed dam wall section 152. This enables dam wall section 154 to self locate its bottom surface 196 against the floor surface 44 or drain fitting 198 defining the drain opening 48. The lower surface 196 of the movable dam wall section 154 may be provided with small leakage openings 200 for the purpose of draining the accumulated water pool 130 after a user terminates his shower.

In order to use the water recirculation system depicted in FIGS. 1–5, the drain adapter assembly 60 should be properly placed over the drain opening 48 and the upper and lower ends of the return tube 62 should be respectively coupled to the nipple 82 on pipe 66 and the nipple 164 on drain adapter housing 150. With these elements in place, now assume that tap water is supplied via elbow 36 to driving nozzle 84 at a flow rate which will be assumed to be 1.5 gallons per minute. The supplied tap water discharged at a high velocity from driving nozzle 98 will create a suction within suction inlet 80, thus initially drawing air upwardly through return tube 62. However, as water is discharged from shower head 68, it will accumulate as pool 130 around the drain adapter assembly 60 because the aforementioned drain openings 200 are dimensioned to drain water at a substantially lesser rate than it is discharged from the shower head 68. For example, it has been found that a total flow rate through leakage openings 200 of about 0.25 gallons per minute is suitable. Thus, the difference between the assumed supply flow rate of 1.5 gallons per minute and the drain rate of 0.25 gallons per minute enables the pool 130 to initially accumulate at a rate of approximately 1.25 gallons per minute.

As the pool grows, water will be drawn from the pool 130 by the suction communicated from the suction inlet 80 via tube 62 to the suction outlet 166, through filter material 160 into the chamber 168 around outlet 166. Water from the chamber 168 will then traverse the return tube 62 to the pump's suction inlet 80. The return flow rate via tube 62 will increase, from zero to e.g., 1.5–2.0 gallons per minute, thus resulting in an approximate 3.0–3.5 gallon per minute discharge from shower head 68. The height to which the pool 130 will accumulate is limited by the height of the fixed dam wall section 152, as is best depicted in FIG. 2. That is, as the pool 130 increases in height, it will overflow the fixed wall section 152, as is depicted by flow arrows 206, into the drain opening 48. In use, the user will control the temperature of the water discharged from shower head 68 via valve handles 26, 27. When the user terminates his shower, the pool 130 will drain off through the leakage openings 200 as is depicted by the flow arrows 210.

Figure 6:
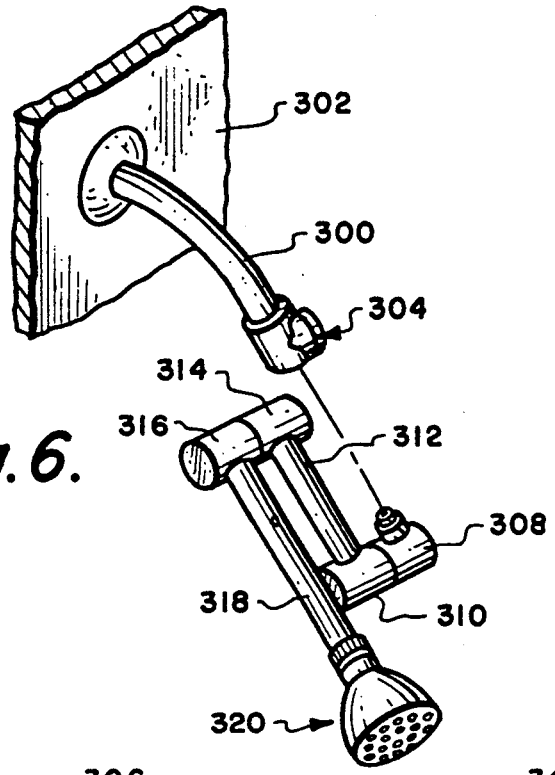
FIG. 6 is an isometric view of an alternative shower arm configuration in accordance with the invention incorporating an ON/OFF valve.
Figure 7:
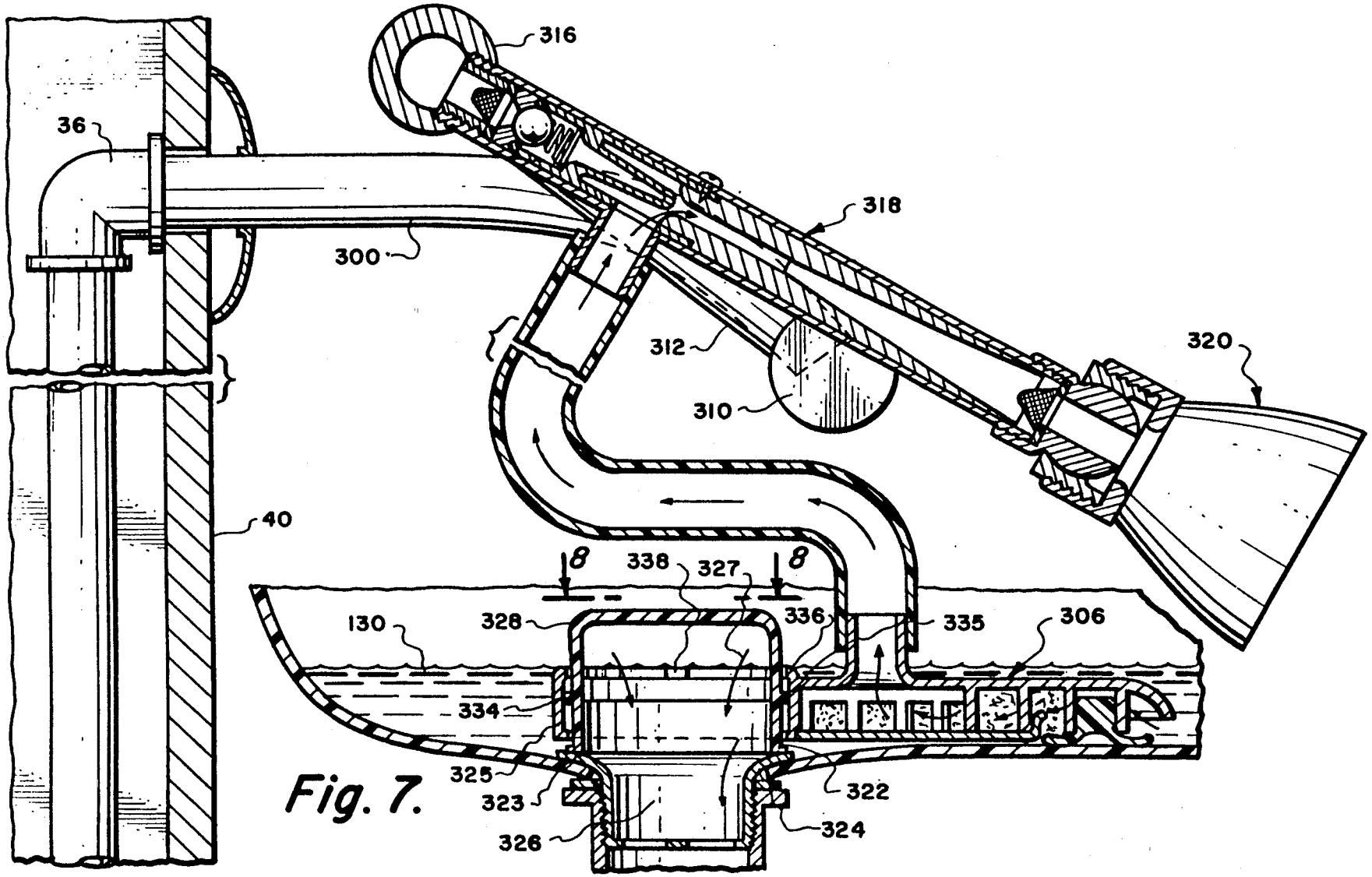
FIG. 7 is a sectional view depicting the alternative shower arm configuration of FIG. 6 together with an alternative drain adapter assembly for use therewith.

Attention is now directed to FIGS. 6 and 7 which depict an alternative shower arm configuration in which a fixed pipe section 300 is coupled to a tap water supply pipe via nipple 36 and emerges from the wall 40. FIG. 6 depicts a valve 304 mounted on the downstream end of pipe 300. Such valves 304 are frequently used in severe water restriction areas in order to enable a user to turn the water flow off while he is lathering. In installations where such a valve is used to maximize water conservation, an alternative drain adapter assembly is employed, as depicted in FIGS. 7–10, to prevent draining the accumulated water pool while the water flow discharge is temporarily stopped. Before describing the alternative drain adapter assembly 306, it should be noted that the shower arm assembly depicted in FIG. 6 further includes a fixed coupler element 308 intended to be threaded and operatively coupled to valve 304. A first swivel element 310 is operatively coupled to coupler 308, and is connected via a short pipe section 312 to a second swivel element 314. The element 314 is operatively coupled to swivel element 316 which in turn carries shower arm 318 which incorporates a jet pump, as depicted in FIG. 7, corresponding to the jet pump 64 previously described in connection with FIG. 2. Pipe arm 318 carries shower head 320 which can be identical to the aforementioned shower head 68.

It will be recalled that the drain adapter assembly 60 of FIGS. 2, 4 and 5 includes a movable dam wall section 154 which includes leakage openings 200 to assure that the pool 130 drains after the user terminates his shower. In installations in which the user may want to temporarily terminate the shower head flow while lathering in order to maximize water conservation, use of the aforedescribed drain adapter assembly 60 would not be satisfactory because the leakage openings 200 could deplete the pool 130. Accordingly, an alternative drain adapter assembly 306 (FIGS. 7–10) is provided which assures that the water pool 130 is accumulated and maintained even during an interval in which shower head flow temporarily ceases. The drain adapter assembly 306 differs from the aforedescribed assembly 60 in that its movable dam wall section 322 omits the leakage openings and has a continuous lower surface 323 adapted to fully seal against drain fitting 324. That is, when the dam wall section 322 is in its lower position as shown in FIG. 7, water discharged from the shower head 320 will continue to accumulate to form pool 130 to a height determined by the height of fixed dam wall section 325 after which it will overflow into drain opening 326 as represented by flow arrows 327.

Figure 10:
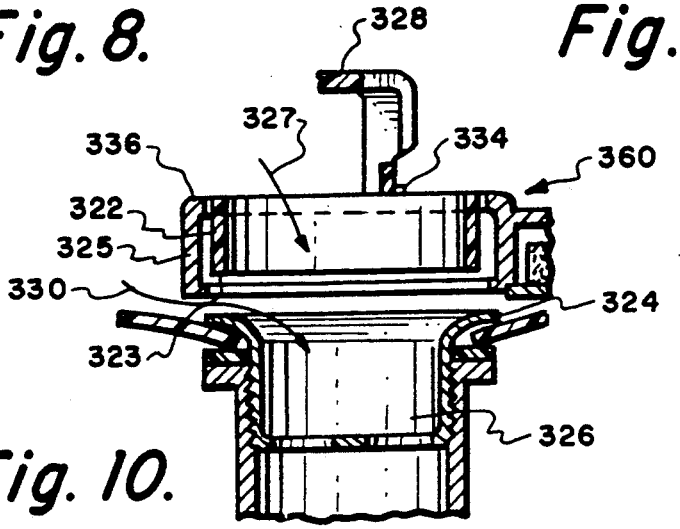
FIG. 10 is a sectional view taken substantially along the plane 10—10 of FIG. 9 showing the drain adapter in its open position.

A handle 328 is affixed to the movable dam wall section 322 enabling it to be raised from its lower or closed position depicted in FIG. 7 to the open position depicted in FIG. 10 in which clearance is provided between the dam wall lower surface 323 and drain fitting 324, thus enabling pool water to drain into drain opening 326 as depicted by flow arrow 330.

Figure 8:
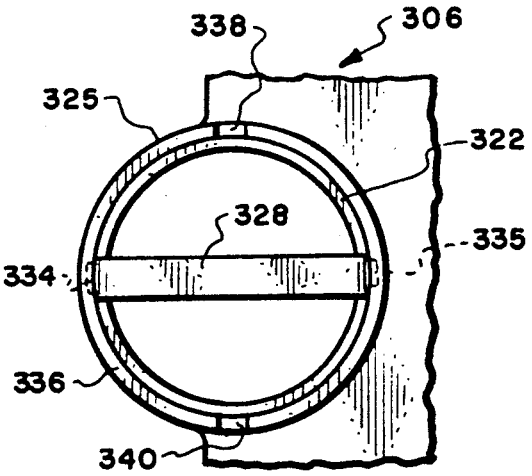
FIG. 8 is a sectional view taken substantially along the plane 8—8 of FIG. 7 showing the drain adapter handle in its closed position.
Figure 9:
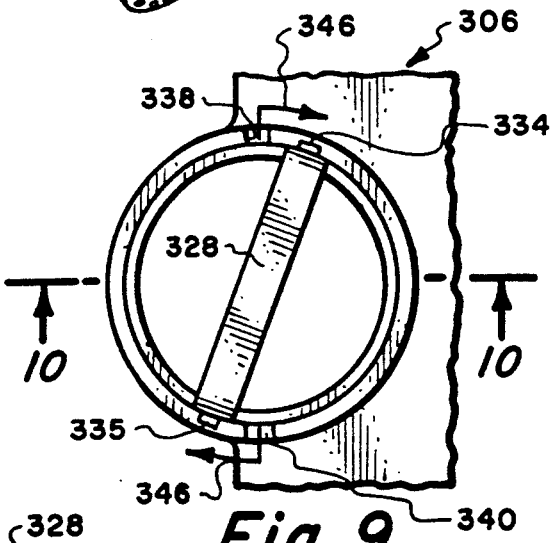
FIG. 9 is a view similar to FIG. 8, but showing the drain adapter handle turned to its open position.

As is best shown in FIG. 8, the movable dam wall 322 is provided with first and second radially projecting ears 334, 335. An upper lip 336 on the fixed dam wall 325 is provided with corresponding openings 338 and 340 through which the ears 334 and 335 can pass vertically. Thus, to move the dam wall section 322 from its lowered close position shown in FIG. 7 to its raised open position shown in FIG. 10, a user would grasp the handle 328 and rotate it to align ears 334, 335 with openings 338, 340. The user can then lift the handle 328 to move the ears, 334, 335 through the openings 338, 340 and then rotate the handle as is suggested by arrows 346 in FIG. 9 to retain the dam wall 322 in its raised position (FIG. 10).

In the use of the alternative drain adapter assembly 306, the user will move the dam wall section 322 to its lower position prior to supplying water to the shower head 320. Thereafter, as water is discharged from the shower head 320, it will accumulate to form pool 130 and will be maintained even when the user temporarily shuts off the shower head flow, as by utilization of valve 304. When the user is finished showering, he will raise the dam wall section 322 to the position depicted in FIG. 10 to thus drain the pool 130. In other respects, the embodiment of FIG. 7 operates similarly to the embodiment of FIG. 2.

Figure 11:
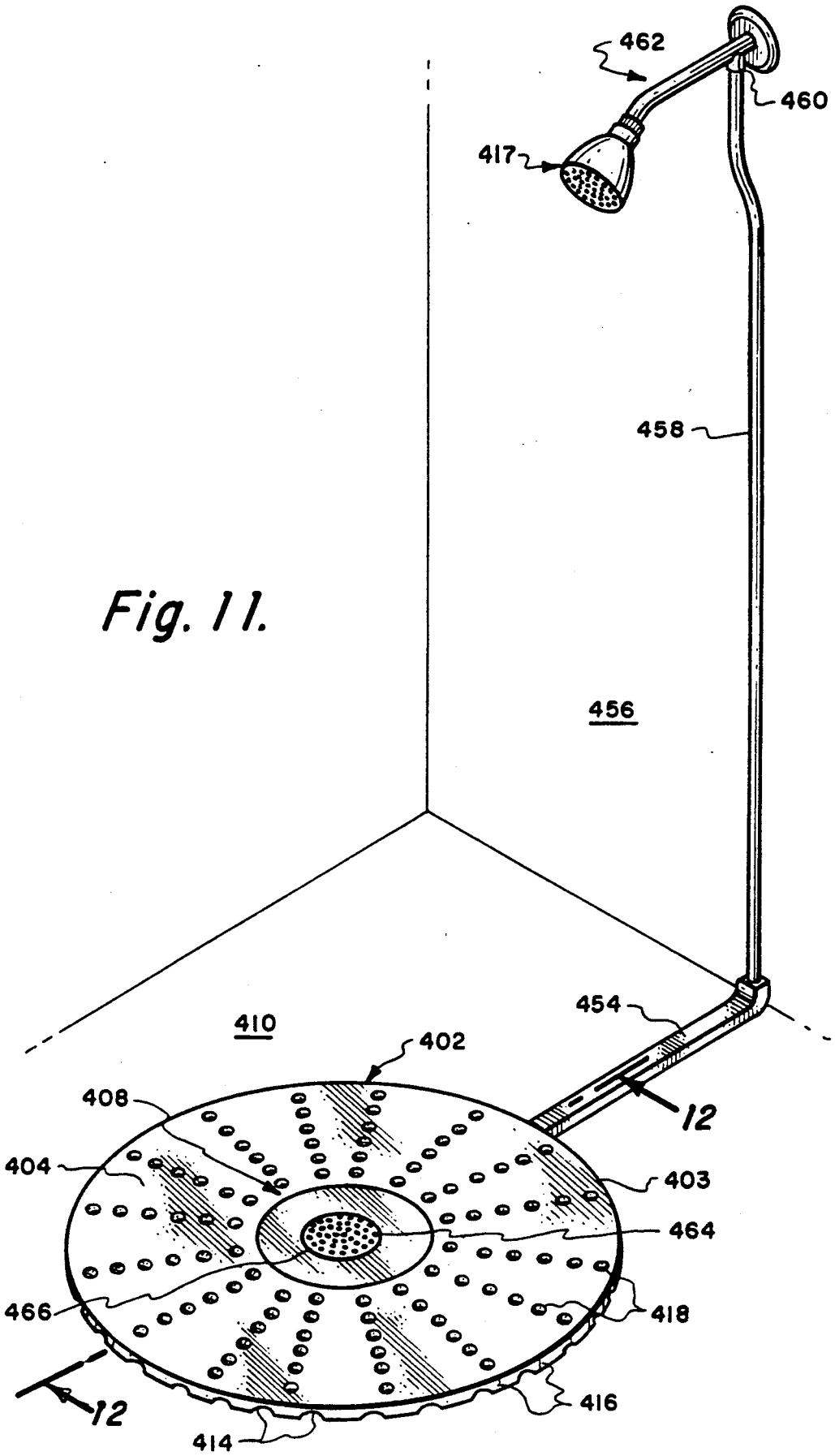
FIG. 11 is an isometric view showing a preferred drain adapter assembly essentially in the form of a mat for use in an after-market shower stall.
Figure 12:
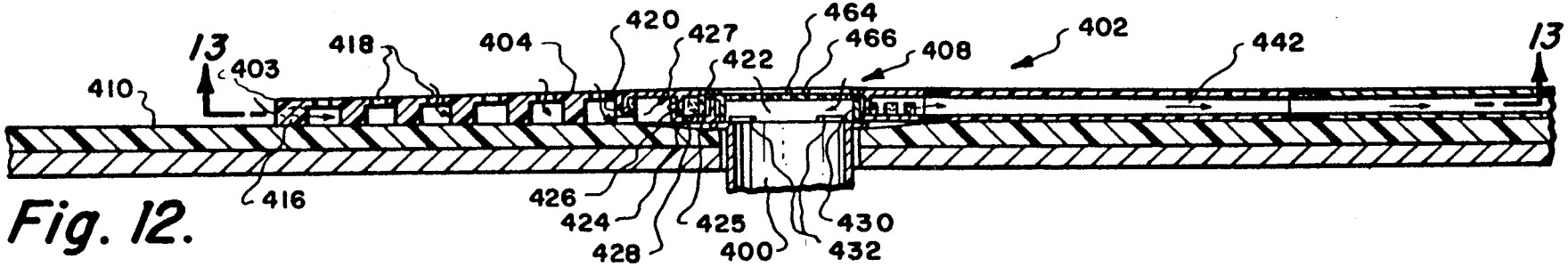
FIG. 12 is a sectional view taken substantially along the plane 12—12 of FIG. 11.
Figure 13:
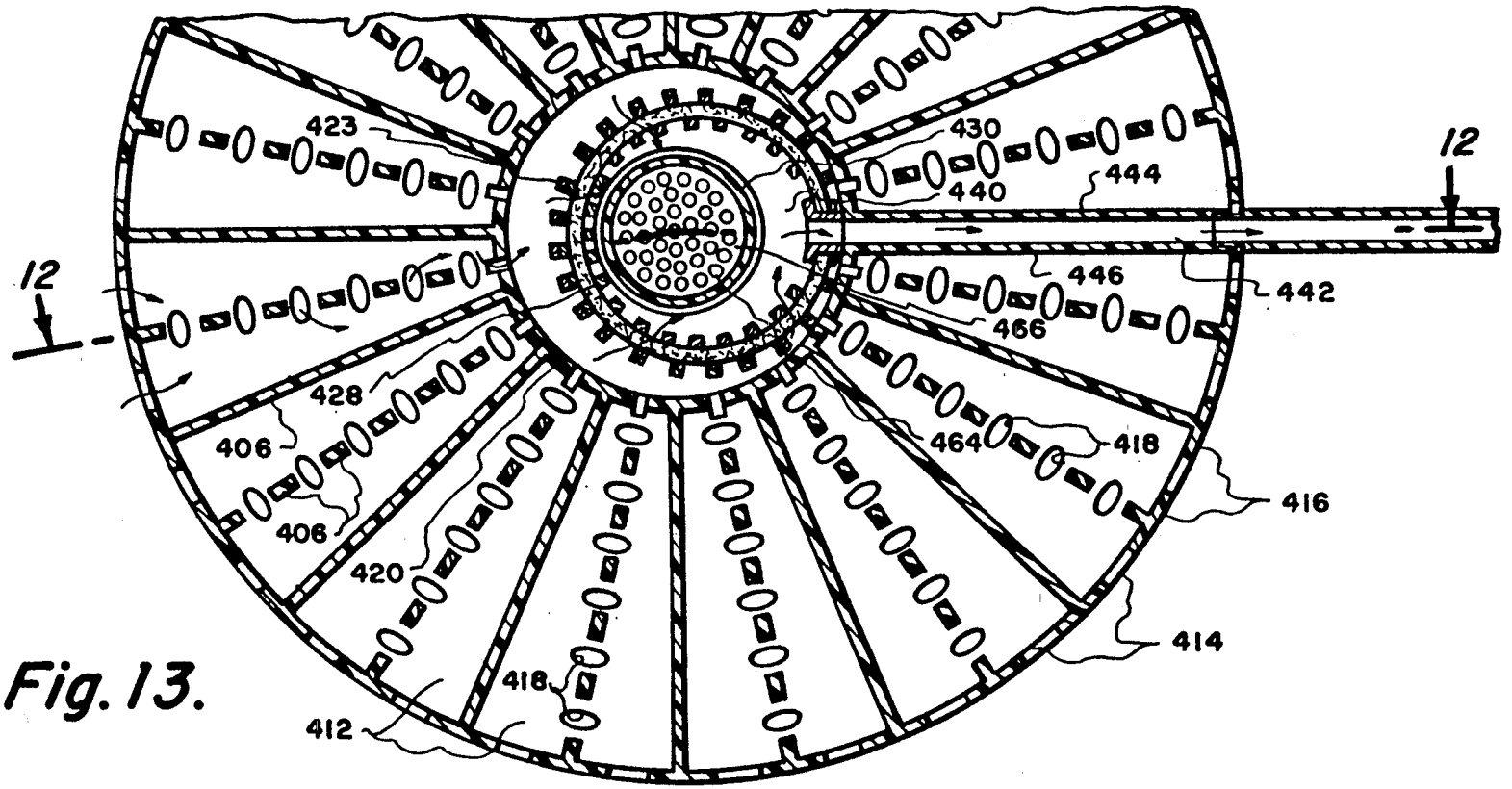
FIG. 13 is a sectional view taken substantially along the plane 13—13 of FIG. 12.

Attention is now directed to FIGS. 11–13 which depict the tap water powered water recirculation system particularly designed for use in conjunction with an existing shower stall installation. In contrast to a typical shower/bathtub installation where the floor mounted drain opening is generally located at one end of the bathtub, in a shower stall the floor mounted drain opening 400 is typically located at the center of the floor area. Because of this location, utilization of a drain adapter assembly 60 (FIG. 2) or 306 (FIG. 7) would not be well suited for use in a shower stall. Accordingly, FIGS. 11–13 illustrate an alternative drain adapter assembly 402 comprising a housing 403 configured in the form of a flat mat upon which a user can stand. More particularly, the drain adapter assembly 402 is comprised of a flat upper plate 404 preferably having a rubberized nonslip top surface. The plate 404 is supported on legs 406 which extend radially from a hub 408 depending from the lower surface of plate 404. The radially extending legs 406 rest on the floor 410 of the shower stall. The radially extending legs 406 essentially divide the underside of the housing 403 into multiple sector compartments 412. Openings 414 are formed around a perimeter support band 416 supporting the plate 404 at its peripheral edge. The openings 414 act as water inlets permitting water discharged from the shower head 417 to flow into the sector compartments 412. Additionally, the upper surface of the plate 404 is provided with holes 418 which permit water discharged from the shower head 417 to enter the sector compartments 412.

The hub 408 is defined by an outer annular wall 420 and an inner annular wall 422. The inner wall 422 is comprised of fingers 423 having outward projections 424. A cover plate 425 having fingers 426 with inward projections 427 cooperates with the fingers 423 to accommodate a piece of filter material 428.

The hub region of the housing 408 further includes a dam wall 430 which surrounds the drain opening 400 to restrict flow into the drain opening. The dam wall 430 may be provided with leakage openings 432, analogous to the openings 200 in FIG. 2, for the purpose of automatically draining pooled water. As water pools around the dam wall 430, it can be pulled through the filter material 428 into pooling chamber 440 by suction communicated via passageway 442 defined between walls 444 and 446 depending from the plate 404. At its outer end, the passageway 442 couples to a tubular extension 454 whose length can be selected so as to terminate adjacent the wall 456. The tubular extension 454 is adapted to be readily coupled to one end of the return tube 458, the other end of which is intended to be coupled to the suction inlet 460 of the pump shower arm assembly 462.

In use, water discharged from the shower head 417 will fall on the upper surface of the plate 404 and then will enter the sector compartments 412 via the holes 418. Additionally, water falling on the floor 410 outside the periphery 416 of the housing 403 will flow into the sector compartments 412 via the openings 414. This water will then flow toward the outer annular wall 420 and through the filter material 428 into the pooling chamber 440. Suction produced by the tap water powered pump assembly 462 via return tube 458 will draw water for recirculation via the passageway 442. The height of the water pool formed beneath the plate 404 is limited to the height of the dam wall 430. That is, as the pool water level reaches the height of the dam wall 430, it will thereafter overflow through openings 464 in grill 466 mounted above the drain opening 400. Thus, the collected water pool is contained essentially beneath the upper surface of plate 404. The upper surface of plate 404 is preferably formed of a non-slip material comfortable to a user's feet. The leakage openings 432 in dam wall 430 assure that when the user terminates his shower, the collected pool water will flow into the drain opening 400 via leakage openings 432.

From the foregoing, it should now be appreciated that a water recirculation system has been disclosed incorporating a tap water powered pump which enables a water discharge device to deliver a flow rate considerably greater than the rate at which tap water is supplied. The invention finds particular utility in connection with shower stall or shower/bathtub installations for enabling a user to experience a high flow rate, e.g., in excess of 3.0 gallons per minute, while taking a lesser flow, e.g., approximately 1.5 gallons per minute, from the tap water supply. Although the preferred embodiments disclosed herein utilize a jet pump incorporated within a pipe arm supporting a shower head, it should be recognized that other types of tap water powered pumps could be utilized. It is also pointed out that although it is particularly convenient to locate the tap water powered pump within the shower pipe arm as depicted in the disclosed embodiments, the pump could, in accordance with the invention, be mounted anywhere between the return opening (e.g., 166) and the shower head inlet, as for example, closer to the drain adapter assembly.

Moreover, although preferred drain adapter assemblies have been disclosed herein for pooling discharged water, it should also be recognized that many alternative means could be used for returning water to the discharge device. For example, in a rather simple embodiment, the drain opening could merely be closed, as by a stopper or existing valve, and the shower stall pan or bathtub could be used to pool water, with the lower end of the return tube (e.g., 62) hanging into the pool.

It should also be understood that although the shower installations depicted herein have included only a single shower head, embodiments of the invention would of course also be useful in multiple head installations in which a single pump could return water to multiple heads or a separate pump could be provided for each head.

We claim:

1. A water recirculation system for use with a source of tap water and a water discharge device mounted about a drain opening, said system comprising;

pooling means positioned relative to said discharge device to collect water discharged therefrom to form a water pool;

pump means having a supply inlet, a suction inlet, and a discharge outlet, said pump means being responsive to tap water supplied by said source to said supply inlet for producing a suction at said suction inlet sufficient to draw water into said pump means for discharge with said supplied tap water through said discharge outlet;

means for coupling said suction inlet to said pool for drawing water therefrom;

means for coupling said discharge outlet to said discharge device; and filter means for filtering water returned from said pool prior to being discharged through said discharge outlet.

2. The system of claim 1 wherein said pump means comprises a jet pump.

3. The system of claim 2 wherein said jet pump includes a driving nozzle having entrance means for coupling to a tap water source and exit means for discharging into a suction chamber; and wherein said suction inlet opens into said suction chamber proximate to said driving nozzle exit.

4. The system of claim 3 including mixing for coupling said suction chamber to said discharge outlet.

5. The system of claim 1 including an elongate pipe having first and second open ends and an intermediate opening; and wherein said pump means is mounted in said pipe with said supply inlet proximate to said pipe first open end, said suction inlet proximate to said intermediate opening and said discharge outlet proximate to said second open end.

6. The system of claim 5 wherein said discharge outlet is coupled to said shower head by threads on said pipe arm second end.

7. The system of claim 5 wherein said pump means comprises a jet pump.

8. The system of claim 1 wherein said pooling means includes a dam wall for restricting water flow into said drain opening to form said pool.

9. The system of claim 8 wherein said pooling means is open above said dam wall to limit the height of said pool.

10. The system of claim 8 including restricted openings in said dam wall defining a water leakage path for draining said pool.

11. The system of claim 8 including means mounting said dam wall for limited movement to permit it to self locate relative to said drain opening.

12. The system of claim 1 further including filter means for filtering water returned from said pool prior to being discharged through said discharge outlet.

13. The system of claim 1 further including unidirectional flow means for preventing water flow from said pump means toward the source of said tap water.

14. A shower water delivery system for use in a shower stall or bathtub having a tap water supply pipe, said system comprising:

a tap water powered pump including a supply inlet coupled to said tap water supply pipe, a discharge outlet coupled to a shower head, an internal passageway coupling said supply inlet to said discharge outlet, and a suction inlet opening into said internal passageway;

said pump including means responsive to tape water supplied to said supply inlet for producing a suction at said suction inlet; and means coupled to said suction inlet for returning water discharged from said shower head to said suction inlet for mixing said returned water with said supplied tap water in said internal passageway for discharge of the resulting mixture through said discharge outlet.

15. The system of claim 14 wherein said shower head is capable of discharging a flow rate exceeding the flow rate of tap water supplied to said supply inlet.

16. The system of claim 14 including a pipe having first and second open ends and an intermediate opening; and wherein said pump is mounted in said pipe with said supply inlet proximate to said pipe first open end, said suction inlet proximate to said intermediate opening and said discharge outlet proximate to said second open end.

17. The system of claim 16 wherein said pump comprises a jet pump.

18. The system of claim 17 wherein said jet pump includes a driving nozzle having an entrance coupled to said tap water supply pipe and an exit discharging into a suction chamber in said internal passageway; and wherein said suction inlet opens into said suction chamber proximate to said driving nozzle exit.

19. The system of claim 18 including mixing means for coupling said suction chamber to said discharge outlet.

20. The system of claim 19 wherein said shower head is capable of discharging a flow rate exceeding the flow rate of tap water supplied to said supply inlet.

21. The system of claim 14 further including unidirectional flow means for preventing water flow from said pump toward said tap water supply pipe.

22. The system of claim 14 wherein said shower stall or bathtub has a floor defining an opening to a drain path; and further including pooling means for blocking said drain path to form a pool of water discharged from said shower head.

23. The system of claim 22 wherein said pooling means is configured for placement on said floor above said drain opening; and wherein said pooling means including a dam wall for restricting water flow into said drain opening.

24. The system of claim 23 wherein said dam wall is selectively movable between a closed position for restricting water flow into said drain opening and an open position for draining said pool into said drain opening.

25. The system of claim 23 wherein said dam wall includes means defining a leakage path to said drain opening for draining said pool.

26. The system of claim 23 including means mounting said dam wall for limited movement for enabling said dam wall to self locate relative to said drain opening.

27. The system of claim 23 wherein said pooling means includes means defining an overflow path to said drain opening for limiting the height of said pool.

28. The system of claim 14 further including filter means for filtering returned water prior to discharge through said discharge outlet.

29. The system of claim 22 wherein said pooling means includes dam wall means for engaging and projecting upwardly from a floor surface of said shower stall or bath tub extending peripherally around said drain opening whereby said pool is formed exteriorly of said dam wall means, said dam wall means defining an overflow path to said drain opening for limiting the height of said pool.

30. The system of claim 29 wherein said pooling means further includes a housing defining a pool water inlet and suction outlet;

filter means mounted in said housing between said pool water inlet and suction outlet; and wherein said means for coupling said suction inlet to said pool includes a tube coupled to said housing suction outlet.

31. The system of claim 30 wherein said filter means includes open cell foam material.

32. The system of claim 30 wherein said housing comprises a substantially flat mat-like structure including a top surface upon which a user can readily stand.

33. The system of claim 29 including means for removably affixing said pooling means to said floor surface.

34. A shower water delivery system for use in a stall or bathtub shower installation having a tap water supply pipe, a floor including a drain opening, and a shower head mounted above said floor to discharge water toward said opening, said system comprising:

water pooling means mounted proximate to said floor for limiting the flow rate of water into said drain opening to form a water pool; and recirculation means for continuously recirculating at least a portion of the water in said pool for discharge through said shower head, said recirculation means including:

pump means having a supply inlet coupled to said supply pipe, a discharge outlet coupled to said shower head, and a suction inlet coupled to said pool, said pump means being responsive to tap water supplied to said supply inlet for drawing water from said pool and discharging a mixture of supplied tap water and drawn pool water through said shower head.

35. The system of claim 34 wherein said pump means includes means for mixing said supplied tap water with said water drawn from said pool prior to discharge through said shower head.

36. The system of claim 34 including means for filtering said water drawn by said pump means.

37. The system of claim 34 including pipe means coupling said supply pipe to said shower head; and wherein said pump means is housed in said pipe means.

38. A shower arm assembly for use in a water recirculation system, said assembly comprising:

pipe means having an open first end for coupling to a tap water supply pipe, an open send end for coupling to a shower head, an internal passageway coupling said first and second ends, and an intermediate opening for coupling to a pool of water discharged from said shower head;

pump means mounted in said pipe means, said pump means being responsive to tap water supplied to said first end for producing a suction at said intermediate opening for drawing water from said pool into said internal passageway for discharging a mixture of supplied tap water and drawn pool water from said second end; and unidirectional flow means mounted in said pipe means proximate to said first end for preventing water flow out of said first end.

39. The assembly of claim 38 wherein said pump means comprises a jet pump.

40. The assembly of claim 39 wherein said jet pump includes a driving nozzle having an entrance communicating with said pipe means first end and an exit for discharging into a suction chamber in said internal passageway; and wherein said pipe means intermediate opening communicates with said suction chamber proximate to said driving nozzle exit.

41. The assembly of claim 40 including mixing means for coupling said suction chamber to said pipe means second end.

42. A drain adapter for use proximate a drain opening in the floor of a shower stall or bathtub for pooling water discharged from a shower head, said adapter comprising:

a housing defining a pool water inlet and a suction outlet;

a dam wall means mounted in said housing for surrounding said drain opening and restricting water flow thereto to thereby pool water in said housing; and filter means mounted in said housing between said pool water inlet and said suction outlet.

43. The adapter of claim 42 including means mounting said dam wall means for limited movement for enabling said dam wall means to self locate relative to said drain opening.

44. The adapter of claim 44 including means defining an overflow path to said drain opening for limiting the height of said pool.

45. The adapter of claim 42 wherein said dam wall means includes openings defining a leakage path for draining said pool.

46. A drain adapter for use proximate a drain opening in the floor of a shower stall or bathtub for pooling water discharged from a shower head, said adapter comprising:

a housing defining a pool water inlet and a suction outlet;

dam wall means mounted in said housing for surrounding said drain opening and restricting water flow thereto to thereby pool water in said housing;

said housing comprising a substantially flat mat-like structure including a top surface upon which a user can readily stand.

47. The drain adapter of claim 46 further including:

filter means mounted in said housing between said pool water inlet and said suction outlet.

48. A method of delivering water from a tap water source to a water discharge device so as to discharge a greater flow rate from the discharge device than is taken from the tap water source, said method comprising the concurrent steps of:

forming a pool of water as it is being discharged from said discharge device;

supplying tap water from said source to a pump to produce a suction at a suction inlet of said pump;

coupling said suction inlet to said pool to draw water from said pool into said pump while water is concurrently being discharged from said discharge device; and delivering from said pump to said water discharge device a flow comprising the water supplied from said tap water source and the water drawn from said pool.

49. The method of claim 48 including the further step of:

providing an overflow path for limiting the height of said pool.

50. The method of claim 48 including the further step of:

automatically draining said pool.

51. The method of claim 48 wherein said water discharge device comprises a shower head, and including the further step of:

mounting said pump within a pipe coupling said tap water source and said shower head.

52. The method of claim 48 including the further step of:

preventing water flow in a direction from said pump to said tap water source.

53. The method of 48 including the further step of:

filtering said water drawn from said pool prior to discharging it from said discharge device.

54. A method of delivering water from a tap water source to a shower head so as to discharge a greater flow rate from the shower head than is taken from the tap water source, said method comprising the current steps of:

supplying tap water from said source to a pump to produce a suction for drawing water discharged from said shower head to a suction inlet of said pump;

delivering a water flow to said shower head comprised of said tap water supplied to said pump and said water drawn to said suction inlet; and mixing the tap water supplied to said pump with the water drawn to said suction inlet to form said flow delivered to said shower head.

55. A method of delivering water from a tap water source to a shower head so as to discharge a greater flow rate from the shower head than is taken from the tap water source, said method comprising the current steps of:

supplying tap water from said source to a pump to produce a suction for drawing water discharged from said shower head to a suction inlet of said pump;

delivering a water flow to said shower head comprised of said tap water supplied to said pump and said water drawn to said suction inlet; and forming a pool of water discharged from said shower head; and wherein said step of coupling comprises communicating said suction inlet with said pool.

* * * * *